United States Patent [19]

Lutich et al.

[11] 4,034,816

[45] July 12, 1977

[54] DEMOLITION TOOL

[76] Inventors: Louis L. Lutich, 1714 Searcy, San Antonio, Tex. 78232; Jesse W. Harris, 527 Sonnet Drive, San Antonio, Tex. 78216

[21] Appl. No.: 683,173

[22] Filed: May 4, 1976

[51] Int. Cl.[2] ..... B25D 1/00

[52] U.S. Cl. ..... 173/15; 60/637; 60/638; 173/134; 173/DIG. 2; 299/37

[58] Field of Search ..... 60/632–638; 173/15–17, 59, 127, 134, DIG. 2; 181/36 A; 123/32 B, 191 R; 299/37

[56] References Cited

U.S. PATENT DOCUMENTS

| | | | |
|---|---|---|---|
| 1,466,968 | 9/1923 | Smith | 60/638 |
| 2,090,842 | 8/1937 | Kiecksee | 173/134 X |
| 2,096,002 | 10/1937 | Moreira et al. | 60/632 X |
| 2,128,742 | 8/1938 | Fuehrer | 173/DIG. 2 |
| 2,135,888 | 11/1938 | Febrey | 60/632 X |
| 3,199,289 | 8/1965 | Ramsey et al. | 60/633 |
| 3,253,399 | 5/1966 | Bakhtar et al. | 60/633 |
| 3,603,406 | 9/1971 | Kahn | 173/134 X |
| 3,817,335 | 6/1974 | Chelminski | 173/127 |

FOREIGN PATENT DOCUMENTS

| | | | |
|---|---|---|---|
| 1,289,689 | 2/1962 | France | 173/134 |
| 553,373 | 6/1932 | Germany | 173/16 |
| 37,918 | 9/1923 | Norway | 123/32 B |
| 279,527 | 11/1971 | U.S.S.R. | 173/127 |

*Primary Examiner*—Lawrence J. Staab
*Attorney, Agent, or Firm*—Cox, Smith, Smith, Hale & Guenther Incorporated

[57] ABSTRACT

The present invention is a projectile type demolition tool. A projectile with an enlarged upper cross-sectional area is slideably mounted within and extendable from an inner cylinder. The lower portion of the projectile is extendable through a guide connected to the bottom of the inner cylinder. Upon pressing a working end of the projectile against a work piece to be broken, the projectile recedes upward in the inner cylinder until the enlarged upper area moves above a source of low pressure gas connected through the inner cylinder. The low pressure gas continues to move the projectile upward in the inner cylinder to a cocked position. In the cocked position, a reduced area upper portion of the projectile acts against a moderately high pressure gas injected into a combustion chamber. Thereafter, a high pressure gas is created by an internal combustion in the combustion chamber, which high pressure gas drives the projectile downward into the work piece. During downward movement, the entire upper surface of the projectile is exposed to the high pressure gas. The high pressure gas is exhausted through ports in the inner cylinder into an annulus formed by an outer cylinder, and thereafter through a base support between the outer cylinder and the guide. Any lateral forces that are exerted on the projectile as it breaks the work piece are countered by the cylinders and guide.

10 Claims, 8 Drawing Figures

DEMOLITION TOOL

BACKGROUND OF THE INVENTION

The present invention relates to demolition tools and, more particularly, to demolition tools of the projectile type. The present invention is designed to raise the striking force of a demolition tool thereby making it more effective against a large work piece. A single piece projectile is propelled to a high velocity before striking the work piece. By using a single piece projectile, there are no energy losses as commonly associated with the conventional hammer striking the conventional chisel of a jackhammer. This greatly reduces the potential for damage or wear in the demolition tool. This invention is further directed toward the physical structure required to generate the high kinetic energy in the projectile, to protect the demolition tool from damage, and to produce a more practical and useful demolition tool. The projectile receives energy from a source of high pressure gas.

BRIEF DESCRIPTION OF THE PRIOR ART

Prior to the present invention, there were many types of demolition tools similar to the traditional jackhammer used in construction work. These devices have several characteristics in common. A hammer is accelerated by a high pressure fluid, such as air. The hammer strikes a pointed shaft commonly called a chisel which extends from the housing of the jackhammer. The pointed shaft is firmly held against a work piece. A fairly high repetition rate of the hammering action drives the shaft into the work piece.

In the use of a device such as a jackhammer, when one metal part strikes another metal part there is a significant amount of energy lost within the jackhammer itself. A very loud noise results from metal striking metal. This noise is difficult to muffle because the structural members of the jackhammer tend to carry the noise.

In devices using a hammer-anvil configuration, the striking surface of the hammer and anvil become very important. There is an upper limit to the amount of energy that can be transferred by a given contact surface area and still avoid breakage, deformation and/or excessive wear. This factor is a major design consideration of jackhammer and vehicle mounted demolition units. When high energy levels are required, the contact surfaces must become very large. It is not uncommon for a backhoe mounted unit to weigh as much as 3,000 pounds.

Due to the previously mentioned design limitations on the striking force of jackhammers and backhoe mounted units, attempts have been made to compensate for low striking power by increasing the striking frequency. However, with the higher frequency rate, a larger volume of pressurized fluid is necessary. A larger volume of pressurized fluid means a more expensive compressor as an auxiliary unit. Furthermore, the mobility of such a unit is severely limited by the large hoses required to provide the high volume of pressurized fluid which is necessary to increase the striking frequency.

One of the major problems in previous jackhammers and backhoe mounted units involves the shaft that extends from the unit to deliver the striking blow on the work piece to be broken. Because there is no structure to react against the lateral forces that may be exerted on the shaft, the shaft is frequently broken or bent. The lateral forces are normally caused from the striking of a slanting surface of the work piece, or the use of the shaft as a pry bar. Many times the shaft is driven into and wedged within the work piece being broken. The shaft may be damaged in attempts to loosen it.

Because the jackhammers and backhoe mounted units have a high rate of repetition to compensate for the lack of energy per blow, there is a tremendous problem of wear within these devices. The shafts, hammers and seals have to be replaced frequently, not to mention components of the expensive auxiliary compressor.

SUMMARY OF THE INVENTION

It is an object of the present invention to provide a high energy, low repetition rate demolition tool of the projectile type.

It is another object of the present invention to provide a demolition tool having a free projectile located inside of an inner cylinder. The free projectile delivers its major striking force as it begins to project from a guide attached to the inner cylinder.

It is yet another object of the present invention to provide a demolition tool operated by a small volume of low pressure gas. In operation, a point of the projectile is placed against a work piece to be broken. By pressing the demolition tool against the work piece, the projectile will slide upward inside of an inner cylinder. Low pressure gas fed into the inner cylinder below a head of the projectile drives the projectile into a cocked position. Thereafter, the projectile is driven down into the work piece by a sudden surge of high pressure gas. The high pressure gas may be valved into inner cylinder, or the result of an internal combustion. The high pressure gas above the projectile is then exhausted via passages to an annulus formed by an outer cylinder. The outer cylinder forms a housing for the demolition tool and gives lateral support for the projectile guide. The outer cylinder may be used as a means for attachment.

The demolition tool of the present invention is designed for operation with a source of low pressure gas, normally air. High pressure gas that is used to drive the projectile downward may be generated by any source. Typically, high pressure gas may be generated by an explosion in a combustion chamber immediately above the projectile. This explosion will drive the projectile into the work piece to be broken. As the projectile projects from the inner cylinder in response to the high pressure exerted thereabove, it will strike the work piece immediately upon projecting out of the guide attached to the lower portion of the inner cylinder. The high pressure gas above the projectile is exhausted through the inner cylinder into an annulus formed by an outer cylinder located therearound. At the bottom of the outer cylinder, a base with holes therethrough exhausts the high pressure gas from the annulus. The outer cylinder via the base is in an abutting relationship with the guide to counteract lateral forces on the guide and projectile. Gas trapped below the projectile head will prevent the projectile from striking the guide which may damage the demolition tool. Otherwise, if the projectile were driven through the work piece being broken, the projectile would strike the guide.

DESCRIPTION OF THE PREFERRED EMBODIMENT

Figure 1A:
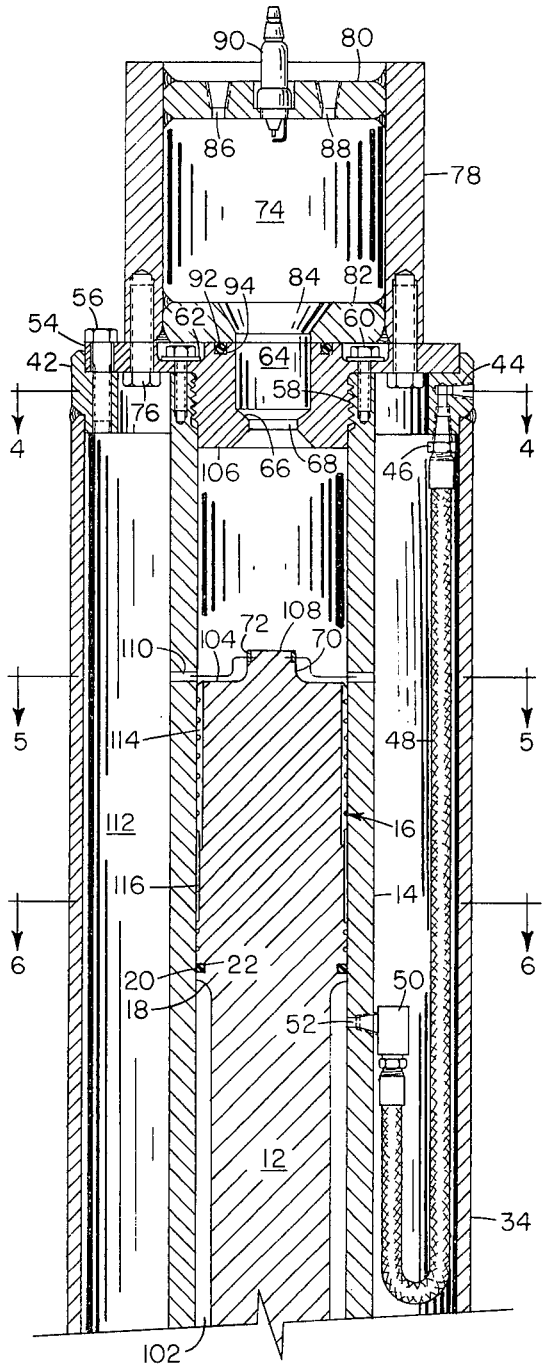
FIGS. 1*a* and 1*b* are a cross sectional view of the demolition tool along its longitudinal axis with the projectile pressing against a work piece to be broken.
Figure 1B:
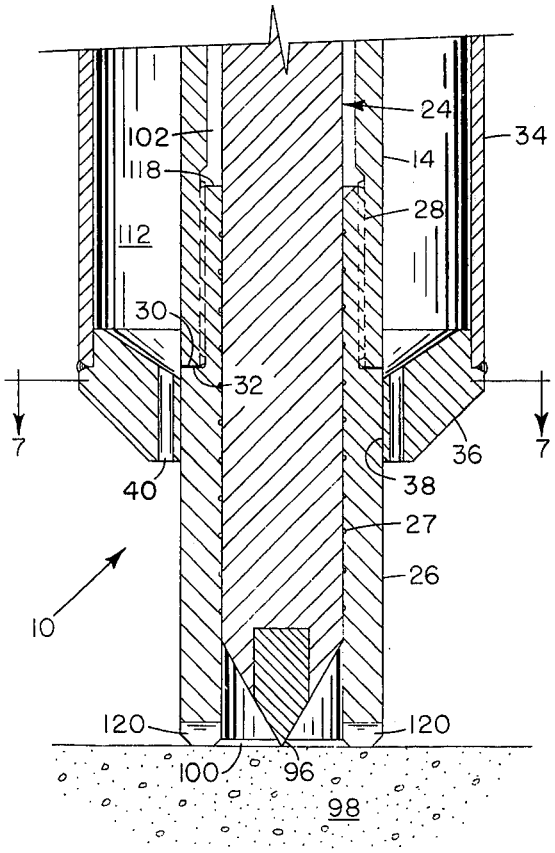

Referring first to FIG. 1 of the drawings, there is shown a demolition tool represented generally by the reference numeral 10. The demolition tool 10 has a projectile 12 freely slideable inside of inner cylinder 14. The projectile 12 has a head 16 with a lowermost shoulder 18. O-ring seal 20 is located in groove 22 of the head 16 and provides a slideable seal with the internal surface of the inner cylinder 14. The shank 24 of the projectile 12 is slideably guided by guide 26. Guide 26 is threadably connected by threads 28 to the lowermost portion of inner cylinder 14. Shoulder 30 of guide 26 abuts the bottom 32 of inner cylinder 14.

Figure 7:
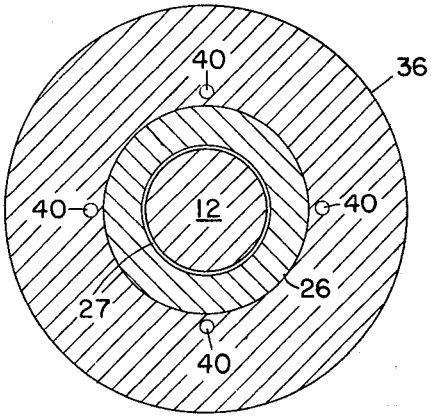
FIG. 7 is a cross sectional view of FIG. 1 along sectional lines 7—7.

Outer cylinder 34 is connected to a base support 36 by any suitable means, such as welding. The center opening 38 of base support 36 is only large enough for the guide 26 to extend therethrough in a close abutting relationship. Also, the base support 36 has a series of exhaust ports 40 extending therethrough. The base support 36, guide 26 and shank 24 of projectile 12 can be better understood when viewed in conjunction with FIG. 7. Grooves 27 in guide 26 help provide a good labyrinth seal with the shank 24.

Figure 4:
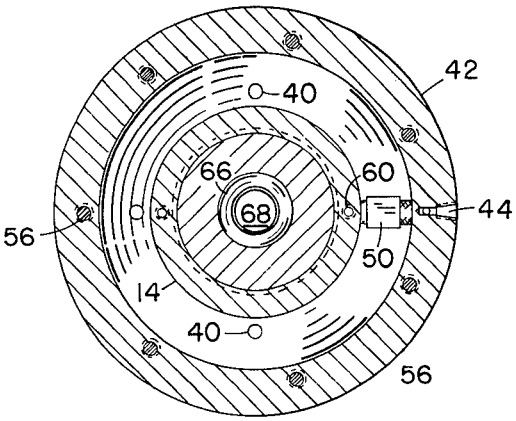
FIG. 4 is a cross sectional view of FIG. 1 along sectional lines 4—4.
Figure 6:
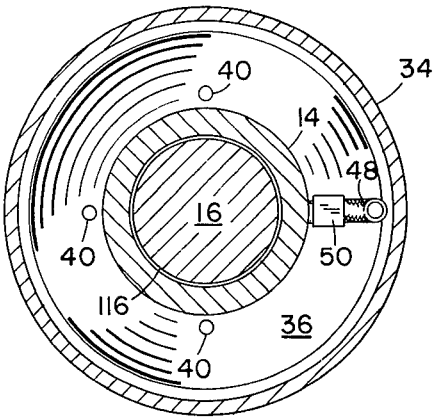
FIG. 6 is a cross sectional view of FIG. 1 along sectional lines 6—6.

The top of the outer cylinder 34 is connected to cylinder head 42 by any suitable means, such as welding. An inlet port 44 of the cylinder head 42 is connected to a source of low pressure gas such as air (not shown). From inlet port 44, the low pressure gas is connected via threaded fitting 46, flexible hose 48 and threaded elbow fitting 50 to inner cylinder inlet 52. The cylinder head 42 is threadably connected to cap 54 by means of bolts 56. A better understanding of the construction of the cylinder head 42, cap 54 and inner cylinder 14 can be obtained by viewing FIG. 1 in conjunction with FIG. 4.

The cap 54 is also connected to the inner cylinder 14 by threaded connection 58. To insure that the inner cylinder 14 does not loosen from cap 54, locking bolts 60 extend through the cap 54 into the top of the inner cylinder 14. The locking bolts 60 are securely held by lock washers 62.

In the middle of the cap 54 is located a high pressure fluid passage 64, which is reduced in size by inwardly directed restriction 66. The inwardly directed restriction 66 forms an opening 68 that is just large enough to receive the reduced cross sectional area of the upper portion 70 of the projectile head 16. Wear resistant material 72, such as tungsten carbide, is located around upper portion 70 to prevent wear.

A combustion chamber 74 is connected to cap 54 by means of bolts 76. The combustion chamber 74 is formed by cylindrical outer wall 78, top 80 and bottom 82. The cylindrical outer wall 78, top 80 and bottom 82 of combustion chamber 74 may be connected together by any suitable means, such as welding. The bottom 82 has an opening 84 freely communicating with high pressure fluid passage 64 of cap 54. In the top 80 is located a fuel inlet passage 86 and an air inlet passage 88 for connection to a source of fuel and air (not shown). Also located in top 80 is an ignition device 90, such as a spark plug. The ignition device 90 connects to an ignition means (not shown). An O-ring seal 92 is located in groove 94 of cap 54 to prevent leakage between cap 54 and base 82 of combustion chamber 74.

Still referring to FIG. 1, assume that the hardened tip 96 is formed from any suitable substance, such as carbide. If the projectile 12 is pressed against work piece 98 to be broken, the projectile 12 will be pushed upward in inner cylinder 14 until the work piece 98 rests against the bottom 100 of the guide 26. Immediately prior to the bottom 100 of guide 26 coming to rest against work piece 98, inner cylinder inlet 52 will be uncovered by shoulder 18 of head 16 of the projectile 12. The uncovering of inner cylinder inlet 52 allows the low pressure gas to pressurize annulus 102 formed between the shank 24 of projectile 12 and inner cylinder 14. The pressurization of annulus 102 will cause projectile 12 to move upward to the cocked position as shown in FIG. 2, with upper shoulder 104 of the projectile 12 coming to rest against the bottom 106 of cap 54.

Figure 2:
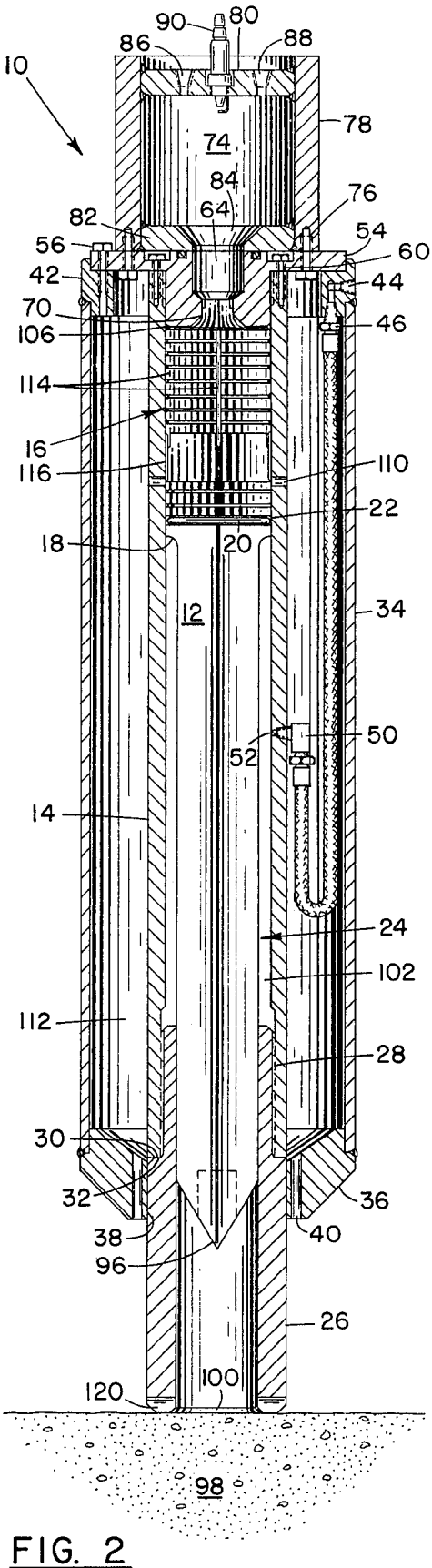
FIG. 2 is a reduced scale, schematic cross sectional view of the demolition tool along its longitudinal axis with the projectile in the cocked position.
Figure 3:
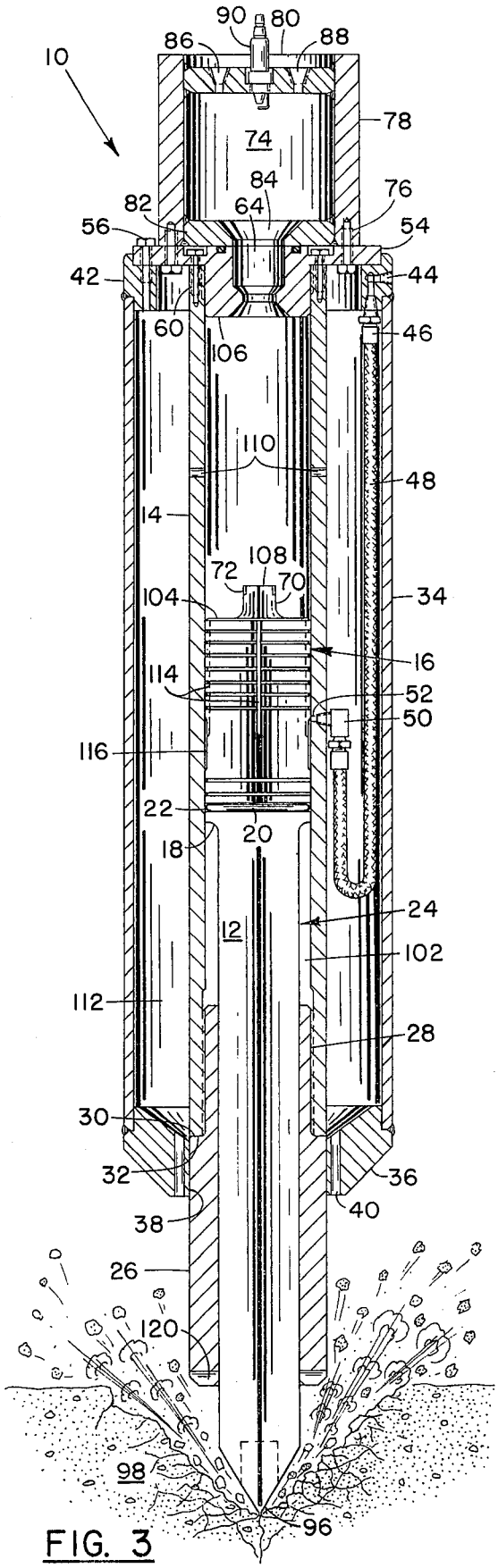
FIG. 3 is a reduced scale, schematic cross sectional view of the projectile along its longitudinal axis with the projectile having been driven from the demolition tool to shatter the work piece.

As can be seen in FIG. 2, the upper portion 70 of the projectile 12 is now located in opening 68 of cap 54. A fuel-air mixture is now injected into combustion chamber 74 via fuel inlet passage 86 and air inlet passage 88. The ignition device 90 ignites the fuel-air mixture to cause an explosion inside of combustion chamber 74. The combustion in turn creates a very high pressure gas which exerts a high pressure on upper surface 108 of projectile 12. Because the high pressure created by the explosion in combustion chamber 74 times the area of upper surface 108 is greater than the pressure in annulus 102 times the area of shoulder 18, the projectile 12 will be driven downward. As the upper portion of the projectile 12 leaves opening 68, the pressure created by the explosion in combustion chamber 74 will now act on the entire upper surface of the projectile 12 formed by upper surface 108 and upper shoulder 104. This high pressure times the large surface area will drive the projectile 12 downward with a high velocity to shatter the work piece 98 as shown in FIG. 3.

The upper portion 70 of projectile 12, and the upper surface 108 thereby, plays several important roles in the operation of the demolition tool 10. By exposing only upper surface 108 to the pressures in chamber 74, it is possible to charge the chamber 74 to a medium range pressure before combustion, thereby generating the high pressure gas. By using the reduced area formed by upper surface 108, the projectile 12 is held in position while the fuel-air mixture is injected into chamber 74. The pressure in chamber 74 will reach a peak value during combustion before the projectile 12 is moved downward, unplugging opening 68. This causes a more complete combustion resulting in high temperatures, and a higher pressure in chamber 74. As soon as opening 68 is unplugged, the high pressure gas developed in chamber 74 acts on the entire upper surface (upper shoulder 104 and upper surface 108) of projectile 12. This high pressure gas continues to act on the entire upper surface of projectile 12 until exhaust ports 110 are uncovered, which is simultaneous with the hardened tip 96 of the projectile 12 striking the work piece 98. (See FIG. 1.) Therefore, the high pressure gas gives the maximum amount of force over the maximum distance thereby transmitting the maximum kinetic energy to the projectile 12 with the minimum amount of energy loss.

This particular design is equally effective for monopropellent combustion, or for a high pressure gas valved into chamber 74.

As the upper shoulder 104 clears exhaust ports 110, the high pressure gas created by the explosion in combustion chamber 74 will be exhausted to outer annulus 112 formed by inner cylinder 14 and outer cylinder 34. From the outer anulus 112, the high pressure created by the explosion in combustion chamber 74 will be allowed to escape through exhaust ports 40. The outer annulus 112 acts in much the same manner as a muffler on an automobile to decrease the sound of the explosion in combustion chamber 74.

Figure 5:
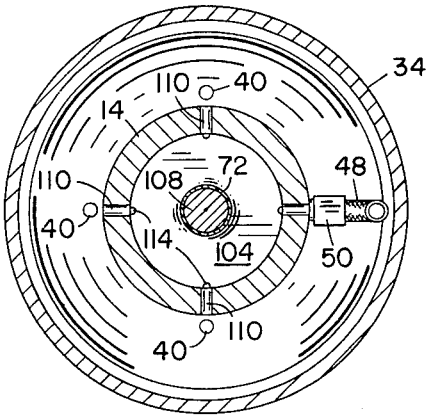
FIG. 5 is a cross sectional view of FIG. 1 along sectional lines 5—5.

Upon picking up the demolition tool 10 and bringing the hardened tip 96 to rest against another portion of the work piece 98, the projectile 12 will again be moved upward in inner cylinder 14. Notches 114, which can be more clearly seen in FIG. 5, will allow any remaining high pressure gas to escape through exhaust ports 110. It should be realized that the notches 114 are very small, and would only allow a residue of high pressure gas to escape, but are not sufficiently large to appreciably affect the downward driving force of an explosion in combustion chamber 74. The notches 114 connect to small annulus 116 formed between head 16 of projectile 12 and inner cylinder 14. The small annulus 116 is also used to reduce friction between the projectile 12 and inner cylinder 14.

Upon driving the projectile 12 downward by an explosion in combustion chamber 74 as previously described, the annulus 102 has low pressure gas trapped therein. Should the hammer 12 break through the work piece 98, or if the demolition tool 10 is picked off of work piece 98, the gas trapped in annulus 102 will continue to pressurize as the volume becomes smaller thereby acting as a cushion for the projectile 12 to prevent shoulder 18 from ever striking top 118 of guide 26. The gas cushion will cause projectile 12 to spring upward thereby keeping the projectile 12 from wedging in work piece 98. Notches 120 are cut in the bottom 100 of guide 26 to prevent any air from being trapped therein to cushion the striking force of the projectile 12.

The high kinetic energy of projectile 12 is created by the explosion in combustion chamber 74 acting on the large upper surface area of the projectile 12. The high kinetic energy of the projectile 12 will literally shatter the work piece 98 upon impact without the necessity of repeated blows at a high repetition rate as described in the prior art. The present demolition tool 10 does not have the high noise level created in prior jackhammers or similar devices because of metal-to-metal contact between a hammer and chisel. A further reduction in the noise level is accomplished by the outer annulus 112 acting as a muffler to the explosion in combustion chamber 74.

With the bottom of the guide 100 resting against the work piece 98, the impact of the blow of the projectile 12 is delivered as the projectile 12 extends through the guide 26. The guide 26 and outer cylinder 34 will counteract any lateral forces that may be exerted on the projectile 12 thereby preventing breakage or bending of the shank 24.

Gas trapped in annulus 102 will cause the projectile 12 to partially recoil after striking work piece 98. Since the projectile 12 will not be stuck in the work piece 98, and will be freely suspended in inner cylinder 14, it cannot be used to pry, thereby bending the shank 24. If prying is necessary, it may be done by guide 26 which is securely held in position by outer cylinder 34 and base support 36. It should be understood that the outer cylinder 34, as well as the inner cylinder 14, is made from very sturdy material that can withstand the lateral forces that may be exerted in the demolition tool 10.

While the demolition tool 10 is not shown connected in a particular system, it may be of the hand held type, or a larger type which would be mounted on a backhoe unit. All that would be necessary for the hand held type would be for handles to be connected thereto, and with the fuel line, air line and electrical connection being carried through a single flexible cable and hose combination.

The high pressure gas in combustion chamber 74, may result from combustion or traditional fuel-air mixtures, as is common in internal combustion engines. Also, it may result from a monopropellant used in combustion chamber 74. A monopropellant demolition tool 10 would be much simplier than a fuel-air combustion type tool; however, fuel operated internal combustion devices are more familiar to the general public.

The demolition tool 10 may also be operated by a low volume, yet very high pressure source of gas, that is simply valved into chamber 74. This would eliminate the necessity for ignition device 90 or a source of fuel. A low volume, high pressure compressor would be necessary, but such a compressor is much cheaper than the high volume compressors currently being used with traditional jackhammers and backhoes units. A valving device would simply dump a predetermined amount of high pressure gas into chamber 74, thereby driving projectile 12 downward to shatter material 98.

Demolition tool 10 may also be manufactured as a hand held unit. The characteristic "one-shot" operation of this demolition tool 10 allows the force of the blow to be much higher than an operator can tolerate in conventional jackhammers. Other features of the demolition tool 10 (low noise level, light weight and minimum auxiliary equipment) make it commercially attractive.

We claim:

1. A demolition tool for breaking solid materials, said demolition tool connecting to a source of low pressure gas, said demolition tool comprising:

outer housing means having an elongated axis;

inner housing means carried by and spaced apart from said outer housing means, said inner housing means being located within said outer housing means;

projectile means axially extendable from said inner housing means to a first predetermined point and retractable within said inner housing means to a second predetermined point, said projectile means having an enlarged upper portion;

passage means for connecting said source of low pressure gas below said enlarged upper portion of said projectile means when said projectile means reaches an intermediate point between said first and second predetermined point during its upward movement in response to pressing said projectile means against said solid materials, said low pressure gas moving said projectile means upward to said second predetermined point;

means for periodically connecting high pressure gas through an upper opening in said inner housing means, said high pressure gas acting against a reduced cross-section area of said enlarged upper portion of said projectile means to drive said projectile means downward in response thereto, said high pressure gas acting against the entire enlarged upper portion upon said projectile means reaching a third predetermined point during its downward movement, said projectile means striking said solid material as said projectile means extends from a lower opening in said inner housing means; and means for exhausting said high pressure gas from above said enlarged upper portion of said projectile means when said projectile means reaches a fourth predetermined point during the downward movement thereof.

2. The demolition tool as recited in claim 1 further comprising:

cap means for connecting an upper end of said outer housing means to an upper end of said inner housing means, said upper opening being in said cap means;

base structure means for abutting a lower portion of said inner housing means and connecting to a lower end of said outer housing means.

3. The demolition tool as recited in claim 2 wherein said inner housing means includes guide means for said abutting of said base structure means, said guide means and said outer housing means counteracting lateral forces on said projectile means.

4. The demolition tool as recited in claim 3 wherein exhausting means includes first exhaust port in said inner housing means, muffling space between said inner housing means and said outer housing means, and second exhaust port from said muffling space to atmosphere.

5. The demolition tool as recited in claim 3 wherein said projectile means has a cushion space between said enlarged upper portion thereof and said guide means, said cushion space trapping gas between said projectile means and said inner housing means during downward movement of said projectile means.

6. The demolition tool as recited in claim 1 wherein said reduced cross-section area includes a reduced diameter top of said projectile means for snugly fitting within said upper opening when said projectile means is at said second predetermined point.

7. The demolition tool as recited in claim 6 wherein said means for periodically connecting high pressure gas through said upper opening comprises:

combustion chamber mounted on demolition tool above said upper opening;

source of fuel and air feeding into said combustion chamber; and ignition device for igniting said fuel to create said high pressure gas.

8. A demolition tool for breaking solid materials, said demolition tool connecting to a source of low pressure gas, said demolition tool comprising:

housing means having an elongated axis;

projectile means axially extendable from and retractable within said housing means, said projectile means having an enlarged upper portion, said projectile means being adapted to hang at a first predetermined point from a lower opening of said housing means by said enlarged upper portion, said projectile means moving axially inside said housing means to a second predetermined point when pressed against said solid materials;

passage means for connecting said source of low pressure gas below said enlarged upper portion of said projectile means when said projectile means is above said second predetermined point, said low pressure gas moving said projectile means upward to a third predetermined point;

means for periodically connecting high pressure gas through an upper opening in said housing means;

reduced cross-section extension on said projectile means for blocking said upper opening when said projectile means is approximately at said third predetermined point, said high pressure gas first acting on said reduced cross-section extension thereby forcing said projectile means downward to a fourth predetermined point, thereafter said high pressure gas acting on said entire enlarged upper portion of said projectile means to drive said projectile means downward in response thereto, said projectile means striking said solid material as said projectile means extends from said lower opening in said housing means; and means for exhausting said high pressure gas from above projectile means when said projectile means reaches a fifth predetermined point during the downward movement thereof.

9. The demolition tool as given in claim 8 wherein said reduced cross-section extension is located on top of said projectile means, said reduced cross-section extension having a generally cylindrical shape.

10. The demolition tool as given in claim 8 wherein said housing means includes an inner housing means carried by and spaced apart from an outer housing means, said inner housing means being located within said outer housing means.

* * * * *